US005464326A

United States Patent [19]

Knott

[11] Patent Number: 5,464,326

[45] Date of Patent: Nov. 7, 1995

[54] ROTORS FOR GAS TURBINE ENGINES

[75] Inventor: David S. Knott, Loughborough, England

[73] Assignee: Rolls-Royce, PLC, London, England

[21] Appl. No.: 331,542

[22] PCT Filed: Apr. 27, 1993

[86] PCT No.: PCT/GB93/00873

§ 371 Date: Nov. 1, 1994

§ 102(e) Date: Nov. 1, 1994

[87] PCT Pub. No.: WO93/22539

PCT Pub. Date: Nov. 11, 1993

[30] Foreign Application Priority Data

May 7, 1992 [GB] United Kingdom ..... 9209895

[51] Int. Cl.[6] ..... F01D 5/22

[52] U.S. Cl. ..... 416/193 A

[58] Field of Search ..... 416/190, 191, 416/193 A, 196 R; 277/25, 213, DIG. 6

[56] References Cited

U.S. PATENT DOCUMENTS

| | | | |
|---|---|---|---|
| 3,464,709 | 9/1969 | Furgason et al. | 277/213 |
| 3,712,757 | 1/1973 | Goodwin | 416/196 R |
| 3,936,230 | 2/1976 | Helmintoller, Jr. et al. . | |
| 4,045,149 | 8/1977 | Ravenhall | 416/193 A |
| 4,183,720 | 1/1980 | Brantley . | |
| 5,049,035 | 9/1991 | Marlin . | |
| 5,277,548 | 1/1994 | Klein et al. | 416/193 A |

FOREIGN PATENT DOCUMENTS

| | | |
|---|---|---|
| 0275726 | 7/1988 | European Pat. Off. . |
| 0370899 | 5/1990 | European Pat. Off. . |
| 1331209 | 9/1973 | United Kingdom . |
| 2167813 | 6/1986 | United Kingdom . |
| 2171151 | 8/1986 | United Kingdom . |

*Primary Examiner*—Edward K. Look
*Assistant Examiner*—James A. Larson
*Attorney, Agent, or Firm*—Cushman, Darby & Cushman

[57] ABSTRACT

A fan rotor has separate wall members bridging the space between adjacent blades of the rotor to define an inner wall of a flow annulus through the rotor; each wall member is attached to the radially outer face of a disk and opposing side faces to which resilient seal strips are bonded; the seal strips have flange portions which are inclined radially inwardly along a curved edge to produce undulations to enhance the flexibility of the flange portion so that, in operation, as the fan rotor rotates about a central axis of the engine, the flange portions are deflected radially outwardly by centrifugal forces into sealing contact with the adjacent fan blade to seal the inner wall of the flow annulus.

6 Claims, 3 Drawing Sheets

ROTORS FOR GAS TURBINE ENGINES

FIELD OF THE INVENTION

The present invention relates to air compressing rotors and in particular to a fan rotor for a gas turbine engine.

BACKGROUND OF THE INVENTION

A conventional fan rotor for compressing air comprises a disc having a plurality of radially extending blades mounted thereon. The fan blades are mounted on the disc by inserting the radially inner end of the blades in correspondingly shaped retention grooves in the radially outer face of the disc. The fan blades do not have platforms so the inner wall of an annulus for the compressed air is formed by fastening separate wall members to the radially outer face of the disc. The separate wall members bridge the space between pairs of adjacent blades to define the inner annulus wall.

Each separate wall member has resilient strips bonded to the edges adjacent the fan blades. The resilient strips protrude so that they abut the adjacent fan blades. The resilient strips thus seal between the wall members and the fan blade to prevent air leaking past the inner wall of the flow annulus.

A drawback of such an arrangement is that the resilient strips are a close fit with the adjacent blades which leads to difficulties in assembly.

SUMMARY OF THE INVENTION

The present invention seeks to provide a rotor in which the inner wall of the flow annulus is defined by a plurality of wall members which are provided with resilient strips which allow for easier assembly.

According to the present invention a rotor for a gas turbine engine comprises a rotor disc which has a radially outer face on which a plurality of radially extending blades are mounted, the blades being curved in an axially extending direction, separate wall members are provided to bridge the space between adjacent blades to define an inner wall of a flow annulus through the rotor, each of the wall members is adapted for attachment to the radially outer face of the disc and has opposing side faces which are spaced circumferentially from the adjacent blades and which are curved to follow the curvature of the adjacent blades, resilient seal strips being mounted adjacent the opposing side faces of the wall members, characterised in that each resilient seal strip has a flange portion which is inclined radially inward along a curved edge adjacent the opposing side face of the wall member, the edge having a curvature corresponding to the curvature of the opposing side face of the wall member and the angle of inclination of the flange portion varying along the edge to produce undulations in the flange portion which enhance the flexibility of the flange portion, whereby in operation the flange portion of the resilient seal strip is deflected radially outwards by centrifugal forces as the rotor rotates about a central axis of the engine so that the flange portion comes into contact with the adjacent fan blade to seal the inner wall of the flow annulus.

Preferably the angle of inclination of the flange portion is varied to produce substantially sinusoidal undulations in the flange portion. The resilient seal strips may be made from a woven material such as carbon or glass fibre. The flange portion of the resilient seal strip may have a rubber strip attached to the flange portion which comes into contact with the adjacent fan blades when the flange portion is deflected radially outward by centrifugal forces.

BRIEF DESCRIPTION OF THE DRAWINGS

The present invention will now be described with reference to the accompanying drawings in which.

DETAILED DESCRIPTION OF THE INVENTION

Figure 1:
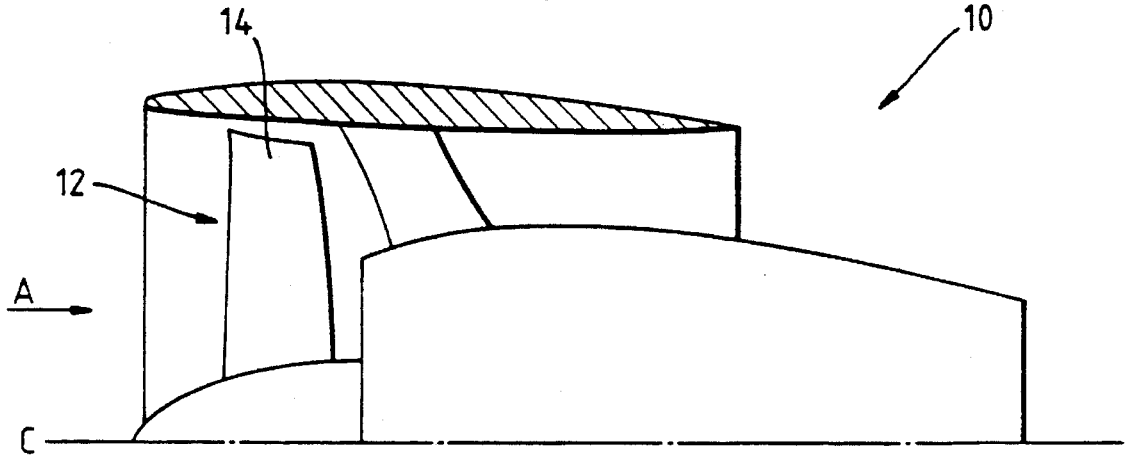
FIG. 1 is a diagrammatic view of a gas turbine engine incorporating a rotor in accordance with the present invention.

Referring to FIG. 1 a gas turbine engine 10, which operates in conventional manner has a fan rotor 12 arranged at its upstream end.

Figure 2:
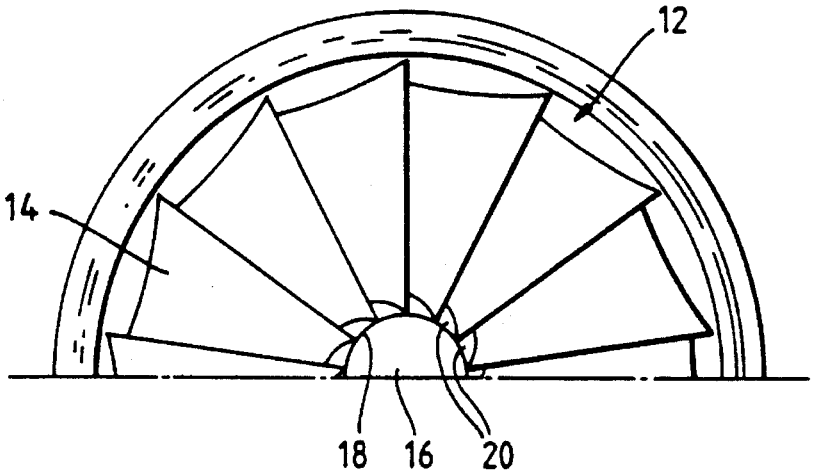
FIG. 2 is a view of a rotor in accordance with the present invention in the direction of arrow A in FIG. 1.

The fan rotor 12 (FIG. 2) consists of a number of fan blades 14 which are mounted on radially outer face 18 of a disc 16. The fan blades 14 are curved in a axially extending direction. The fan blades 14 do not have platforms and the space between adjacent pairs of blades 14 is bridged by wall members 20. The wall members 20 are fastened to the radially outer face 18 of the disc 16 and define the inner wall of a flow annulus for air compressed by the fan.

Each wall member 20 consists of a platform 22 having a foot 24, of dovetail cross-section, which extends radially inwardly of the platform 22. The foot 24 engages a correspondingly shaped retention groove 25 in the radially outer face 18 of the disc 16. Axial movement of the wall members 20 is prevented by mounting an annular ring (not shown), known as a thrust ring on the disc 16.

The platform 22 (FIG. 3) has axially extending side edges 26 which are in close proximity to the adjacent fan blade 14. The side edges 26 of the platform 22 are curved to follow the curvature of the adjacent fan blades 14. Each side edge 26 is provided with a resilient seal strip A portion 27 of the seal strip 28 is bonded along one edge 26 of the platform 22 by adhesive 32. A flange portion 29 of the seal strips 28 is inclined radially inward. The flange portion 29 is inclined along a curved edge 30. The edge 30 has a curvature which corresponds to the curvature of the opposing side edge 26 from which it is mounted. The angle of inclination of the flange portion 29 varies along the curved edge 30 to produce sinusoidal undulations in the flange portion 29 (FIG. 4). In the preferred embodiment of the present invention the flange portion 29 is inclined at an angle of the order of ±4° from the edge 30.

For ease of assembly the seal strips 28 are designed so that the flange portions 29 do not abut the adjacent fan blades 14 when the engine 10 is not in operation.

When the engine 10 is operational the rotor 12 rotates about a central axis C of the engine 10. Centrifugal forces act on the seal strips 28 to deflect the flange portions 29 to the dotted position shown in FIG. 3. The seal strips 28 are deflected radially outwardly into sealing contact with the adjacent blades 14. The seal strips 28 form a seal which prevents the leakage of compressed air through the inner wall of the flow annulus when the rotor 12 is operational. The flange portion 29 of the seal strip 28 has a rubber strip 33 attached thereto. The rubber strip 33 assists in the deflection of the seal strip 28 radially outward under the centrifugal forces and provides a soft contact surface with the adjacent blade 14.

Figure 5:
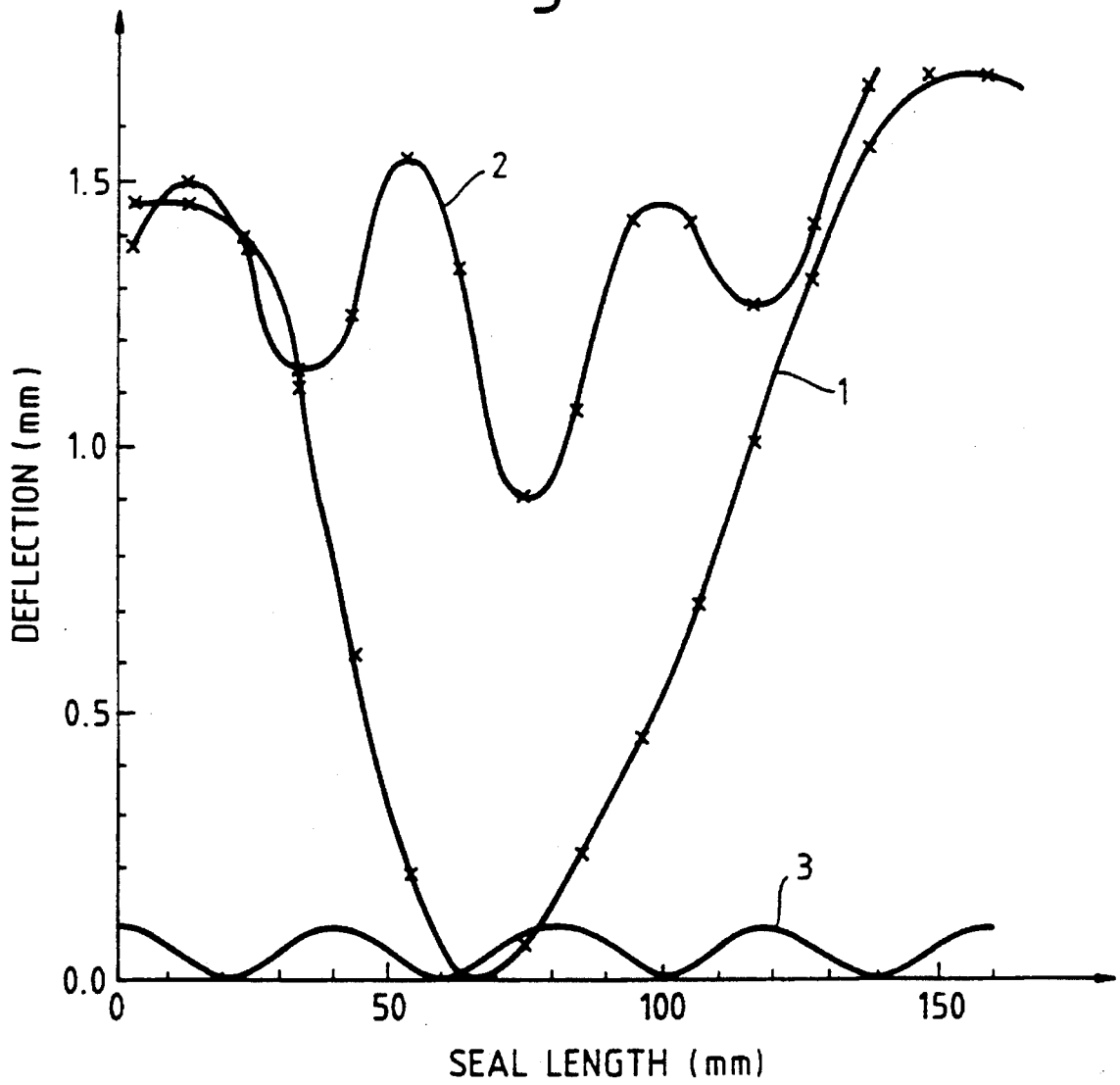
FIG. 5 shows the deflection under centrifugal forces of the flange portion of a seal strip in accordance with the present invention.

FIG. 5 shows the amount of deflection that a seal strip 28 having an undulating flange portion 29 experiences under the centrifugal forces compared to a seal strip 28 having a flange portion 29 which is not undulated.

The deflection of a flange portion 29 which is not undulated is shown by curve 1 in FIG. 5. The curvature of edge 30 stiffens the seal strip 28 and prevents deflection of the flange portion 29 in the middle region of the seal strip 28 at an axial position approximately 65 mm along the seal.

Figure 3:
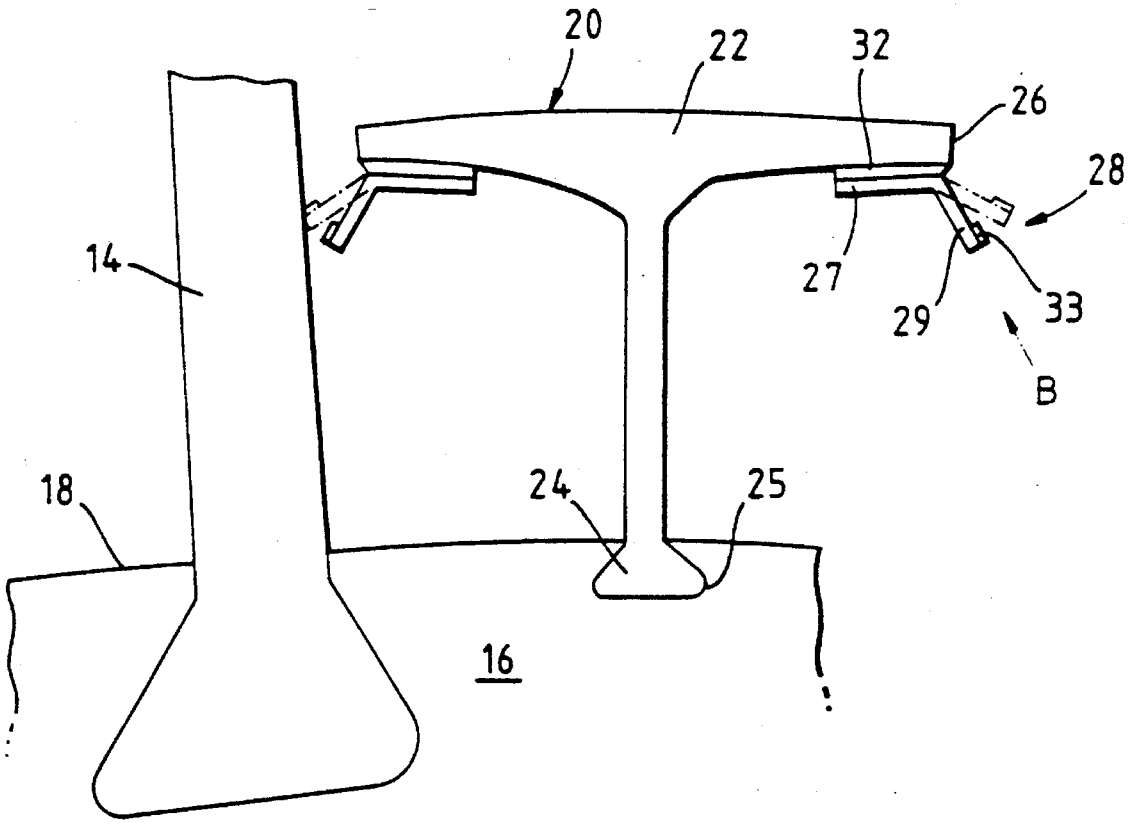
FIG. 3 is an enlarged view of part of the rotor shown in FIG. 2.
Figure 4:
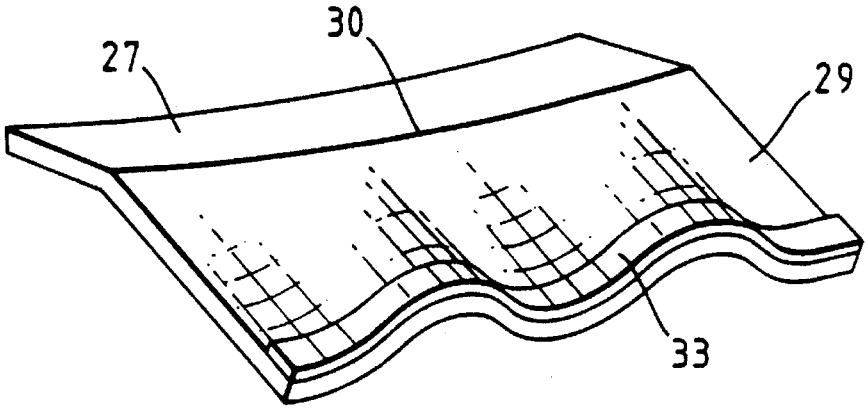
FIG. 4 is a pictorial view of a seal strip for use in a rotor in accordance with one embodiment of the present invention.

Curve 3 in FIG. 5 shows the sinusoidal undulations in a flange portion 29 when viewed in the direction of arrow B in FIG. 3. Curve 2 in FIG. 5 shows the deflection of a flange portion 29 which undulates as shown in curve 3. The sinusoidal undulations enhance the flexibility of the flange portion 29, particularly in the middle region of the seal strip 28, which deflects radially outward under the centrifugal forces.

The undulations reduce the stiffness of the flange portion 29 of the seal strip 28 so that it can compensate for tolerance changes in the gap between the wall member 20 and the adjacent fan blade 14.

In the preferred embodiment of the present invention the seal strips 28 are made from a woven material. The seal strips 28 are woven out of carbon or glass fibres.

I claim:

1. A rotor for a gas turbine engine comprising a rotor disc which has a radially outer face on which a plurality of radially extending blades are mounted having spaces between each pair of adjacent blades, the blades (14) being curved in an axially extending direction, separate wall members being provided to bridge the space between adjacent blades to define an inner wall of a flow annulus through the rotor, each of the wall members being adapted for attachment to the radially outer face of the disc and having opposing side faces which are spaced circumferentially from the adjacent blades and which are curved to follow the curvature of the adjacent blades, resilient seal strips being mounted adjacent the opposing side faces of the wall members, each resilient seal strip having a flange portion which is inclined radially inward along a curved edge adjacent the opposing side face of the wall member, the edge having a curvature corresponding to the curvature of the opposing side face of the wall member and the angle of inclination of the flange portion varying along the curved edge to produce undulations in the flange portions which enhance the flexibility of the flange portion, whereby in operation the flange portion of the resilient seal strip is deflected radially outwards by centrifugal forces as the rotor rotates about a central axis of the engine so that the flange portion comes into contact with the adjacent blade to seal the inner wall of the flow annulus.

2. A rotor as claimed in claim 1 characterised in that the angle of inclination of the flange portion (29) varies along the curved edge (30) to produce sinusoidal undulations in the flange portion (29).

3. A rotor as claimed in claim 1 characterised in that the resilient seal strips (28) are made from a woven material.

4. A rotor as claimed in claim 3 characterised in that the resilient seal strips (28) are made from woven carbon fibres.

5. A rotor as claimed in claim 3 characterised in that the resilient seal strips (28) are made from woven glass fibres.

6. A rotor as claimed in claim 1 characterised in that a rubber strip is attached to the flange portion which contacts the adjacent fan blade when the flange portion is deflected radially outward under centrifugal forces.

* * * * *